US012352476B2

(12) United States Patent
Zha et al.

(10) Patent No.: US 12,352,476 B2
(45) **Date of Patent: *Jul. 8, 2025**

(54) COOLING SYSTEM

(71) Applicant: Heatcraft Refrigeration Products LLC, Stone Mountain, GA (US)

(72) Inventors: Shitong Zha, Snellville, GA (US); Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/631,323

(22) Filed: Apr. 10, 2024

(65) Prior Publication Data

US 2024/0255195 A1 Aug. 1, 2024

Related U.S. Application Data

(63) Continuation of application No. 17/506,515, filed on Oct. 20, 2021, now Pat. No. 11,988,423, which is a (Continued)

(51) Int. Cl.
*F25B 40/04* (2006.01)
*F25B 7/00* (2006.01)
(Continued)

(52) U.S. Cl.
CPC ..... *F25B 40/04* (2013.01); *F25B 7/00* (2013.01); *F25B 41/20* (2021.01); *F25B 49/02* (2013.01); *F25B 2400/13* (2013.01)

(58) Field of Classification Search
CPC .. F25B 40/04; F25B 41/20; F25B 7/00; F25B 49/02; F25B 2400/13
See application file for complete search history.

(56) References Cited

U.S. PATENT DOCUMENTS 6,662,576 B1 12/2003 Bai
11,209,199 B2 * 12/2021 Zha ..... F25B 1/10
(Continued)

FOREIGN PATENT DOCUMENTS

EP 2690376 A1 1/2014
JP 2010127563 A 6/2010
WO 2008019689 A2 2/2008

OTHER PUBLICATIONS

Finn et al., A Transcritical Refrigeration System With A Booster, Feb. 21, 2008, WO2008/019689A2, Whole Document (Year: 2008).*
(Continued)

*Primary Examiner* — Larry L Furdge

(57) ABSTRACT

An apparatus includes a high side heat exchanger, a flash tank, a load, a compressor, and a heat exchanger. The high side heat exchanger removes heat from a refrigerant. The flash tank stores the refrigerant from the high side heat exchanger and to discharge a flash gas. The load uses the refrigerant from the cool a space proximate the load. The compressor compresses the refrigerant from the load. The heat exchanger transfers heat from the refrigerant from the compressor to the flash gas before the refrigerant from the compressor reaches the high side heat exchanger. The heat exchanger directs the flash gas to the compressor after heat from the refrigerant from the compressor is transferred to the flash gas and directs the refrigerant from the compressor to the high side heat exchanger after heat from the refrigerant from the compressor is transferred to the flash gas.

14 Claims, 4 Drawing Sheets

Related U.S. Application Data continuation of application No. 16/269,670, filed on Feb. 7, 2019, now Pat. No. 11,209,199.

(51) Int. Cl.
*F25B 41/20* (2021.01)
*F25B 49/02* (2006.01)

(56) References Cited

U.S. PATENT DOCUMENTS

| | | | | |
|---|---|---|---|---|
| 11,988,423 | B2 * | 5/2024 | Zha | F25B 5/02 |
| 2009/0019878 | A1 | 1/2009 | Gupte | |
| 2011/0023514 | A1 * | 2/2011 | Mitra | F25B 1/10 62/513 |
| 2020/0256599 | A1 | 8/2020 | Zha et al. | |

OTHER PUBLICATIONS

Luo, B., "Oil flooded compression cycle enhancement for two-stage heat pump in cold climate region: System design and theoretical analysis," Energy Conversion and Management, Elsevier Science Publishers, XP029461215, vol. 115, Mar. 10, 2016, pp. 52-59.
European Patent Office, Extended European Search Report, Application No. 20153739.6, dated May 26, 2020, 10 pages.

* cited by examiner

COOLING SYSTEM

CROSS-REFERENCE TO RELATED APPLICATIONS

This application is a continuation of U.S. patent application Ser. No. 17/506,515 filed Oct. 20, 2021, now U.S. Pat. No. 11,988,423 issued May 21, 2024 by Shitong Zha et al., and entitled "COOLING SYSTEM", which is a continuation of U.S. patent application Ser. No. 16/269,670 filed Feb. 7, 2019, now U.S. Pat. No. 11,209,199 issued Dec. 28, 2021 by Shitong Zha et al., and entitled "COOLING SYSTEM," which are incorporated herein by reference.

TECHNICAL FIELD

This disclosure relates generally to a cooling system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY

A typical commercial refrigeration system includes a medium temperature section (e.g., produce shelves) and a low temperature section (e.g., freezers). A low temperature compressor compresses the refrigerant from the low temperature section. A medium temperature compressor compresses a mixture of the refrigerant from the medium temperature section, a flash gas bypass from a flash tank, and/or the compressed refrigerant from the low temperature compressor. Thus, the temperature of the refrigerant from the low temperature section and the temperature of the refrigerant from the medium temperature section and/or gas from the flash tank affect the temperature of the mixture received at the medium temperature compressor. Typically, the refrigerant from the low temperature section heats the refrigerant from the medium temperature section and/or the gas from the flash tank as they are mixed.

A problem occurs in existing systems when the low temperature loads are shut off or removed from a system. For example, a grocery store may decide to downsize and remove freezers but keep produce shelves. As another example, freezers may shut off during regular a cooling cycle or may be taken offline for maintenance. In these systems, there may not be any (or there may be an insufficient amount of) refrigerant from a low temperature section to heat the refrigerant from the medium temperature section and/or gas from the flash tank. Consequently, the refrigerant that is received by the medium temperature compressor may be too cool for the medium temperature compressor to handle appropriately. For example, if the refrigerant is too cool, it may include a liquid component. The liquid may cause oil to foam in the medium temperature compressor as the refrigerant is compressed. As a result of the foam, a shutoff may trigger, and the compressor may be shut down.

Existing systems address this problem by including a hot gas dump valve off the medium temperature compressor. When the superheat of the refrigerant entering the medium temperature compressor is too low, the hot gas dump valve opens to direct refrigerant from the discharge of the medium temperature compressor back to the intake of the medium temperature compressor. Because the refrigerant discharged by the medium temperature compressor is hot, it heats the refrigerant at the medium temperature compressor intake, thus increasing the superheat of the refrigerant at the medium temperature compressor intake. This solution, however, decreases efficiency because the medium temperature compressor must re-compress refrigerant that it had already compressed. Additionally, the hot gas dump valve is expensive and increases the cost of the system.

This disclosure contemplates an unconventional cooling system that obviates the need for a hot gas dump valve by using a heat exchanger to direct heat back to the intake of the medium temperature compressor. The heat exchanger receives hot refrigerant discharged by the medium temperature compressor and a flash gas discharged by a flash tank. The heat exchanger transfers heat from the refrigerant from the medium temperature compressor to the flash gas. The heat exchanger then directs the flash gas to the intake of the medium temperature compressor to increase the superheat of the refrigerant in the medium temperature compressor. In this manner, the heat exchanger transfers heat from the discharge of the medium temperature compressor to the intake of the medium temperature compressor. Certain embodiments of the cooling system are described below.

According to an embodiment, an apparatus includes a high side heat exchanger, a flash tank, a first load, a first compressor, and a heat exchanger. The high side heat exchanger removes heat from a refrigerant. The flash tank stores the refrigerant from the high side heat exchanger and to discharge a flash gas. The first load uses the refrigerant from the cool a first space proximate the first load. The first compressor compresses the refrigerant from the first load. The heat exchanger transfers heat from the refrigerant from the first compressor to the flash gas before the refrigerant from the first compressor reaches the high side heat exchanger. The heat exchanger directs the flash gas to the first compressor after heat from the refrigerant from the first compressor is transferred to the flash gas and directs the refrigerant from the first compressor to the high side heat exchanger after heat from the refrigerant from the first compressor is transferred to the flash gas.

According to another embodiment, a method includes removing, by a high side heat exchanger, heat from a refrigerant and storing, by a flash tank, the refrigerant from the high side heat exchanger. The method also includes discharging, by the flash tank, a flash gas and using, by a first load, the refrigerant from the cool a first space proximate the first load. The method further includes compressing, by a first compressor, the refrigerant from the first load and transferring, by a heat exchanger, heat from the refrigerant from the first compressor to the flash gas before the refrigerant from the first compressor reaches the high side heat exchanger. The method also includes directing, by the heat exchanger, the flash gas to the first compressor after heat from the refrigerant from the first compressor is transferred to the flash gas and directing, by the heat exchanger, the refrigerant from the first compressor to the high side heat exchanger after heat from the refrigerant from the first compressor is transferred to the flash gas.

According to yet another embodiment, a system includes a high side heat exchanger, a flash tank, a first load, a first compressor, a second load, a second compressor, and a heat exchanger. The high side heat exchanger removes heat from a refrigerant. The flash tank stores the refrigerant from the high side heat exchanger and to discharge a flash gas. The first load uses the refrigerant from the cool a first space proximate the first load. The first compressor compresses the refrigerant from the first load. The second load uses the refrigerant from the flash tank to cool a second space proximate the second load. The second compressor compresses the refrigerant from the second load. The first compressor compresses the refrigerant from the second compressor. The heat exchanger transfers heat from the refrigerant from the first compressor to the flash gas before the refrigerant from the first compressor reaches the high side heat exchanger. The heat exchanger directs the flash gas to the first compressor after heat from the refrigerant from the first compressor is transferred to the flash gas and directs the refrigerant from the first compressor to the high side heat exchanger after heat from the refrigerant from the first compressor is transferred to the flash gas.

Certain embodiments provide one or more technical advantages. For example, an embodiment increases the superheat of refrigerant at a medium temperature compressor when the system is lacking a low temperature load. As another example, an embodiment prevents a medium temperature compressor from foaming and shutting down when the superheat of the refrigerant at the intake of the medium temperature compressor is insufficient. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
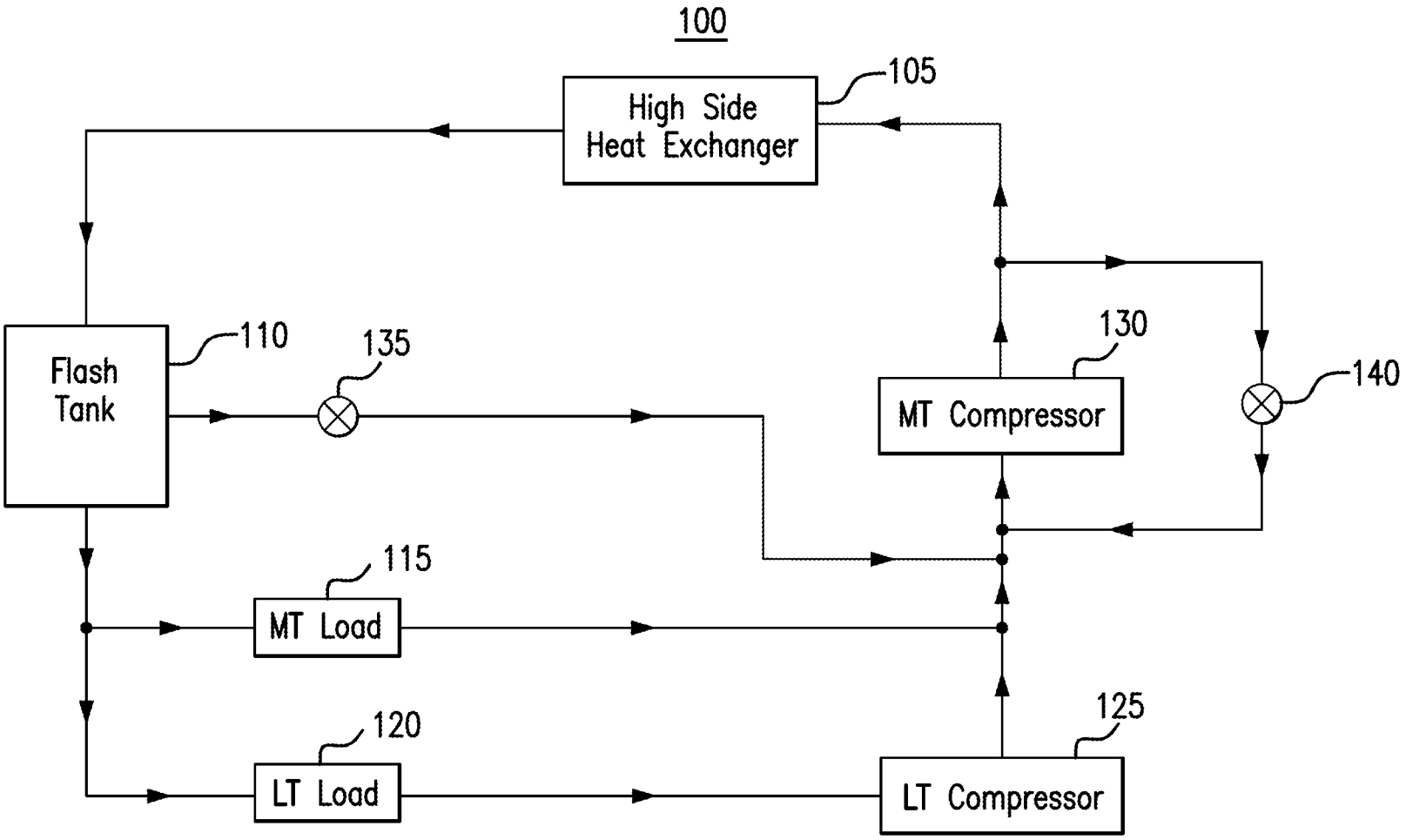
FIG. 1 illustrates an example cooling system.

Embodiments of the present disclosure and its advantages are best understood by referring to FIGS. 1 through 4 of the drawings, like numerals being used for like and corresponding parts of the various drawings.

A typical commercial refrigeration system includes a medium temperature section (e.g., produce shelves) and a low temperature section (e.g., freezers). A low temperature compressor compresses the refrigerant from the low temperature section. A medium temperature compressor compresses a mixture of the refrigerant from the medium temperature section, a flash gas from a flash tank, and the compressed refrigerant from the low temperature compressor. Thus, the temperature of the refrigerant from the low temperature section and the temperature of the refrigerant from the medium temperature section and/or gas from the flash tank affect the temperature of the mixture received at the medium temperature compressor. Typically, the refrigerant from the low temperature section heats the refrigerant from the medium temperature section and/or gas from the flash tank as they are mixed.

A problem occurs in existing systems when the low temperature loads are shut off or removed from a system. For example, a grocery store may decide to downsize and remove freezers but keep produce shelves. As another example, freezers may shut off during regular a cooling cycle or may be taken offline for maintenance. In these systems, there may not be any (or there may be an insufficient amount of) refrigerant from a low temperature section to heat the refrigerant from the medium temperature section and/or gas from the flash tank. Consequently, the refrigerant that is received by the medium temperature compressor may be too cool for the medium temperature compressor to handle appropriately. For example, if the refrigerant is too cool, it may include a liquid component. The liquid may cause oil to foam in the medium temperature compressor as the refrigerant is compressed. As a result of the foam, a shutoff may trigger, and the compressor may be shut down.

Existing systems address this problem by including a hot gas dump valve off the medium temperature compressor. When the superheat of the refrigerant entering the medium temperature compressor is too low, the hot gas dump valve opens to direct refrigerant from the discharge of the medium temperature compressor back to the intake of the medium temperature compressor. Because the refrigerant discharged by the medium temperature compressor is hot, it heats the refrigerant at the medium temperature compressor intake, thus increasing the superheat of the refrigerant at the medium temperature compressor intake. This solution, however, decreases efficiency because the medium temperature compressor must re-compress refrigerant that it had already compressed. Additionally, the hot gas dump valve is expensive and increases the cost of the system.

This disclosure contemplates an unconventional cooling system that obviates the need for a hot gas dump valve by using a heat exchanger to direct heat back to the intake of the medium temperature compressor. The heat exchanger receives hot refrigerant discharged by the medium temperature compressor and a flash gas discharged by a flash tank. The heat exchanger transfers heat from the refrigerant from the medium temperature compressor to the flash gas. The heat exchanger then directs the flash gas to the intake of the medium temperature compressor to increase the superheat of the refrigerant in the medium temperature compressor. In this manner, the heat exchanger transfers heat from the discharge of the medium temperature compressor to the intake of the medium temperature compressor. Certain embodiments of the cooling system are described below.

Figure 2:
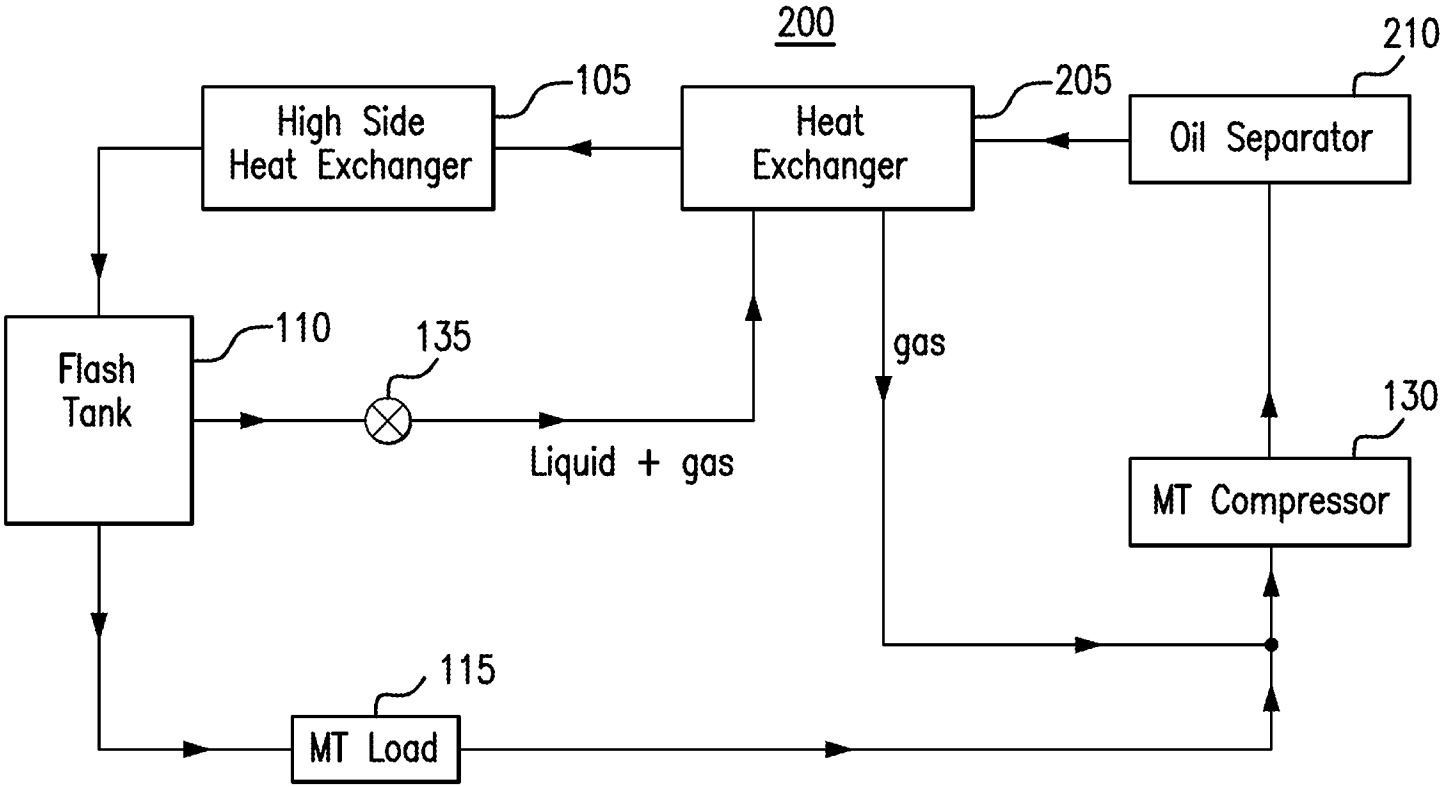
FIG. 2 illustrates an example cooling system.
Figure 3:
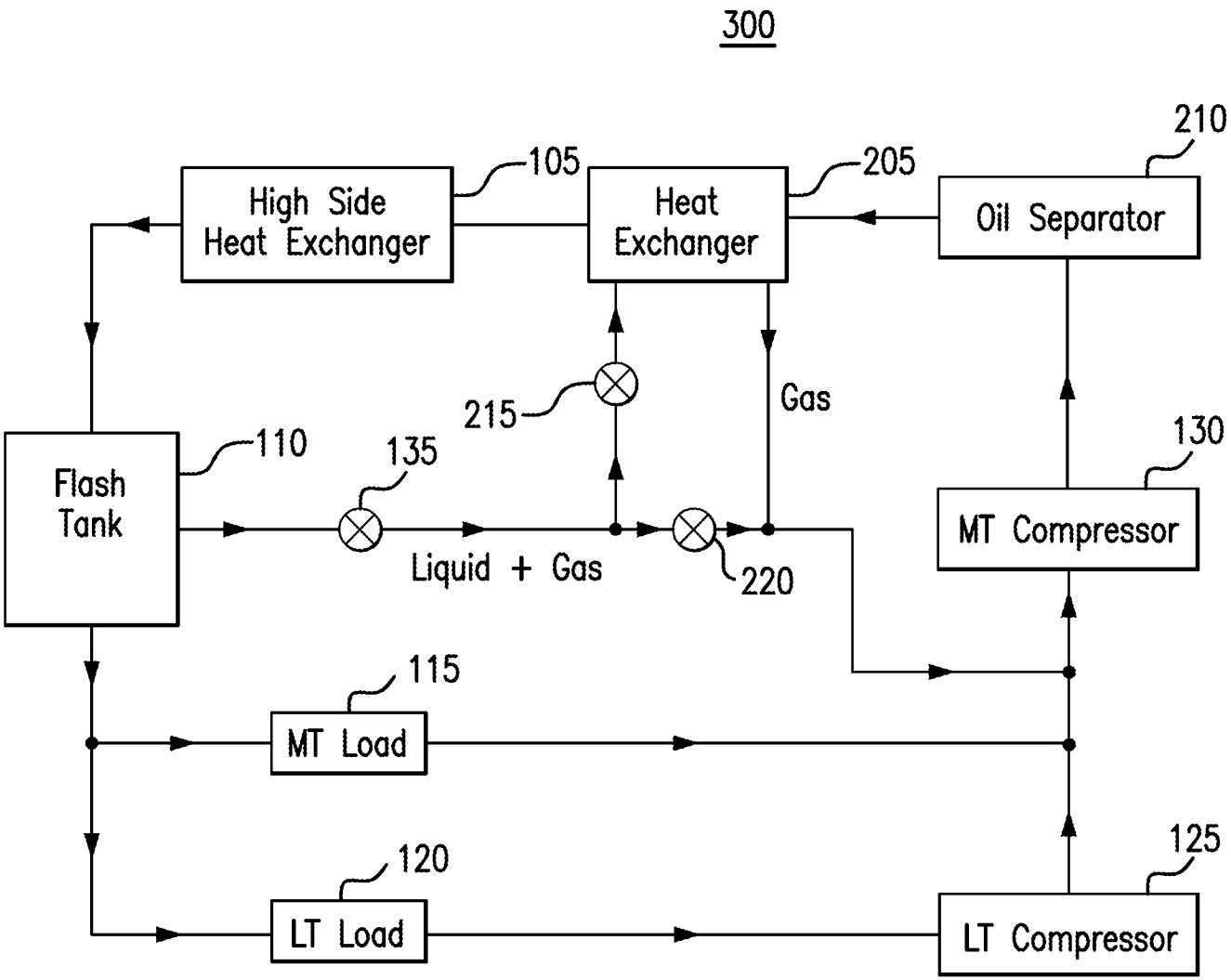
FIG. 3 illustrates an example cooling system.
Figure 4:
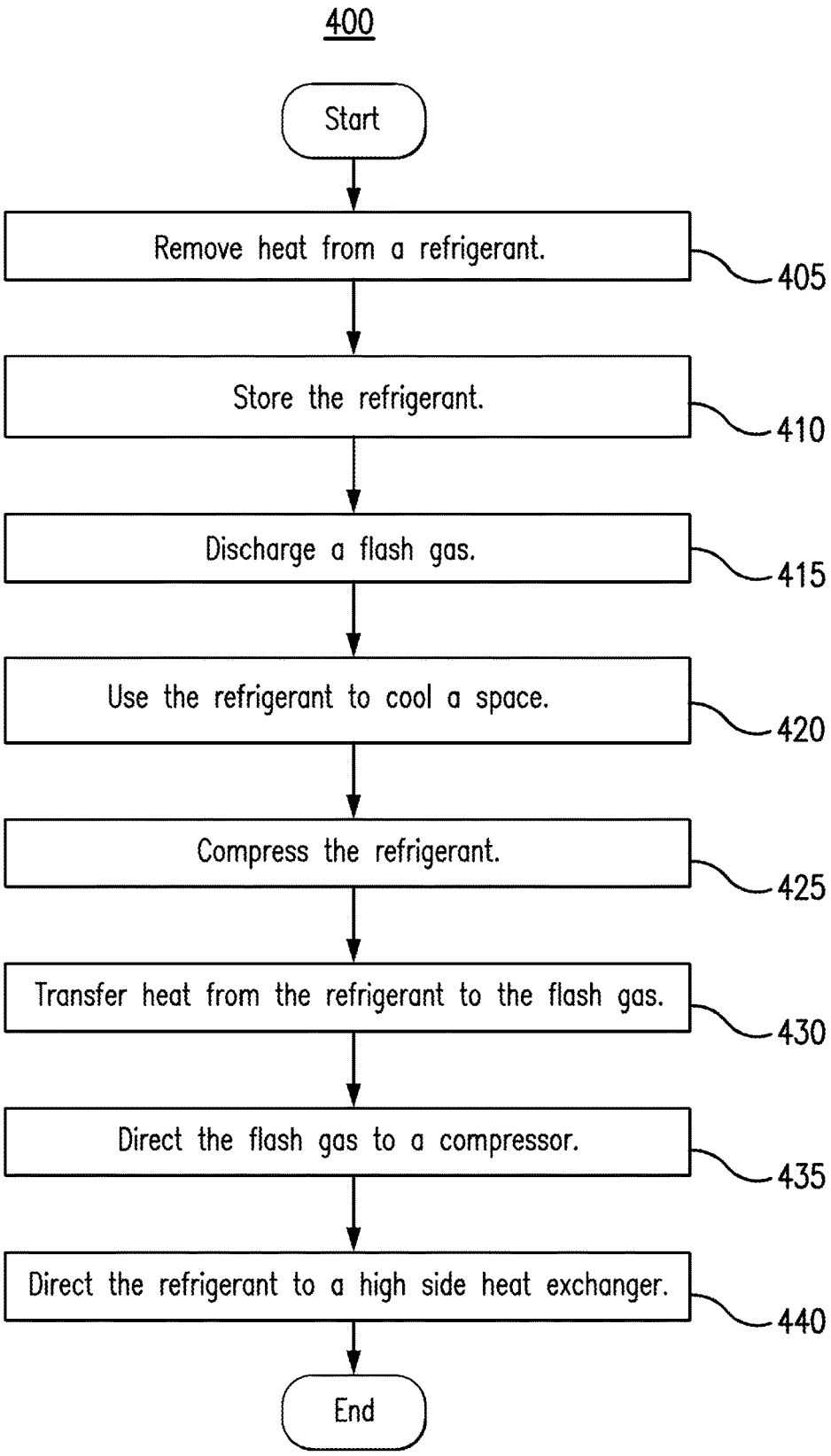
FIG. 4 is a flowchart illustrating a method of operating an example cooling system.

In certain embodiments, the superheat of the refrigerant at the intake of a medium temperature compressor is increased without using a hot gas dump valve. in some embodiments, heat from refrigerant discharged by a medium temperature compressor is returned to the intake of the medium temperature compressor by a heat exchanger. The cooling system will be described using FIGS. 1 through 4. FIG. 1 will describe an existing cooling system with a hot gas dump valve. FIGS. 2 through 4 describe the cooling system with a heat exchanger.

FIG. 1 illustrates an example cooling system 100. As seen in FIG. 1, system 100 includes a high side heat exchanger 105, a flash tank 110, a medium temperature load 115, a low temperature load 120, a low temperature compressor 125, a medium temperature compressor 130, a flash gas bypass valve 135, and a hot gas dump valve 140. Generally, hot gas dump valve 140 is opened to allow the hot discharge from medium temperature compressor 130 to return to the intake of medium temperature compressor 130 when a temperature and/or superheat of the refrigerant mixture at the intake of medium temperature compressor 130 is too low. As a result, the temperature and/or superheat of the refrigerant at the intake is increased.

High side heat exchanger 105 removes heat from a refrigerant (e.g., carbon dioxide). When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

Flash gas bypass valve 135 controls the flow of flash gas from flash tank 110 to medium temperature compressor 130. When valve 135 is open, a flash gas can flow from flash tank 110, through valve 135, to medium temperature compressor 130. When valve 135 is closed, the flash gas cannot flow from flash tank 110 to medium temperature compressor 130. By allowing flash gas to flow from flash tank 110 to medium temperature compressor 130, an internal pressure of flash tank 110 is controlled and/or maintained.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat. This disclosure contemplates including any number of low temperature loads 120 and medium temperature loads 115 in any of the disclosed cooling systems.

Refrigerant flows from low temperature load 120 and medium temperature load 115 to compressors 125 and 130. This disclosure contemplates the disclosed cooling systems including any number of low temperature compressors 125 and medium temperature compressors 130. Both the low temperature compressor 125 and medium temperature compressor 130 compress refrigerant to increase the pressure of the refrigerant. As a result, the heat in the refrigerant may become concentrated and the refrigerant may become a high-pressure gas. Low temperature compressor 125 compresses refrigerant from low temperature loads 120 and sends the compressed refrigerant to medium temperature compressor 130. Medium temperature compressor 130 compresses a mixture of the refrigerant from low temperature compressor 125 and medium temperature load 115 and/or gas from flash tank 110. Medium temperature compressor 130 then sends the compressed refrigerant to high side heat exchanger 105.

In certain instances, low temperature load 120 may not be operating fully or may be removed from system 100 or shut down. In these instances, there may not be enough hot refrigerant from low temperature compressor 125 to mix with the refrigerant from medium temperature load 115 and/or gas from flash tank 110 to raise the superheat of the refrigerant at the intake of medium temperature compressor 130. As a result, the refrigerant compressed by medium temperature compressor 130 may not be sufficiently hot and may even include a liquid component. This liquid component reduces the efficiency of medium temperature compressor 130 and may cause medium temperature compressor 130 to foam, which could lead to a shut down.

Hot gas dump valve 140 controls the flow of refrigerant discharged by medium temperature compressor 130 to increase the temperature and/or superheat of the refrigerant at the intake of medium temperature compressor 130. When valve 140 is open, part of the discharged refrigerant flows back to the intake of medium temperature compressor 130. There, the hot, discharged refrigerant mixes with the refrigerant from medium temperature load 115 and/or gas from flash tank 110 and low temperature compressor 125. As a result, the temperature and/or superheat of the intake is increased. When valve 140 is closed, the discharged refrigerant flows to high side heat exchanger 105. Generally, hot gas dump valve 140 is undesirable because it reduces efficiency by making medium temperature compressor 130 re-compress refrigerant that it has already compressed. Additionally, hot gas dump valve 140 is expensive, which drives up the cost of cooling system 100.

FIGS. 2-4 illustrate example cooling systems that obviate the need for hot gas dump valve 140. Generally, these systems use a heat exchanger to transfer heat back to the intake of medium temperature compressor 130.

FIG. 2 illustrates an example cooling system 200. As seen in FIG. 2, system 200 includes a high side heat exchanger 105, a flash tank 110, a medium temperature load 115, a medium temperature compressor 130, a flash gas bypass valve 135, a heat exchanger 205, and an oil separator 210. Generally, heat exchanger 205 transfers heat from the refrigerant discharged by medium temperature compressor 130 to a flash gas discharged by flash tank 110. The heated flash gas then mixes with the refrigerant at the intake of medium temperature compressor 130 to heat that refrigerant. In this manner, system 200 transfers heat from the discharge of medium temperature compressor 130 back to the intake of medium temperature compressor 130. This transfer of heat allows medium temperature compressor 130 to operate efficiently even when there may be low temperature loads missing from system 200 in certain embodiments.

High side heat exchanger 105, flash tank 110, medium temperature load 115, medium temperature compressor 130, and flash gas bypass valve 135 operate similarly as they did in cooling system 100. For example, high side heat exchanger 105 removes heat from a refrigerant. Flash tank 110 stores the refrigerant. Medium temperature load 115 uses the refrigerant to cool a space proximate medium temperature load 115. Medium temperature compressor 130 compresses the refrigerant from medium temperature load 115. Flash gas bypass valve 135 opens and closes to control a flow of flash gas discharged by flash tank 110. In this manner, the refrigerant is cycled through system 200 to cool a space.

An important difference between system 200 and system 100 is that system 200 does not include a low temperature load or low temperature compressor. As a result, there is no hot refrigerant from a low temperature compressor to mix with the refrigerant from medium temperature load 115 and/or gas from flash tank 110 at the intake of medium temperature compressor 130. Thus, the temperature and/or superheat of the refrigerant at the intake of medium temperature compressor 130 may not be high enough for medium temperature compressor 130 to compress the refrigerant efficiently. Additionally, the refrigerant may include liquid components that cause medium temperature compressor 130 to foam and/or shut down.

System 200 addresses the insufficient temperature and/or superheat at the intake of medium temperature compressor 130 by transferring heat from the discharge of medium temperature compressor 130 back to the intake of medium temperature compressor 130 using flash gas discharged by flash tank 110. Generally, system 200 uses heat exchanger 205 to transfer heat from the refrigerant discharged by medium temperature compressor 130 to flash gas discharged by flash tank 110. The heated flash gas is then directed to the intake of medium temperature compressor 130 where it mixes with the refrigerant from medium temperature load 115. As a result, the temperature and/or superheat of the refrigerant at the intake of medium temperature compressor 130 is increased.

Heat exchanger 205 includes tubes, pipes, and/or plates that transfer heat between two fluids flowing through heat exchanger 205. These components may be made of metal to support the heat transfer. In system 200, heat exchanger 205 is positioned between high side heat exchanger 105 and medium temperature compressor 130. Heat exchanger 205 receives refrigerant from medium temperature compressor 130 and flash gas from flash tank 110. As the refrigerant and the flash gas flow through heat exchanger 205, heat is transferred between these two fluids. For example, heat from the refrigerant from medium temperature compressor 130 is transferred to the flash gas, thus heating the flash gas and cooling the refrigerant. After heat transfer is complete, heat exchanger 205 directs the refrigerant to high side heat exchanger 105 and the flash gas to medium temperature compressor 130. By removing heat from the refrigerant from medium temperature compressor 130, the efficiency of system 200 is improved because high side heat exchanger 105 does not need to work as hard to remove heat from the refrigerant in certain embodiments. Additionally, by heating the flash gas, the efficiency of medium temperature compressor 130 is improved because the temperature and/or superheat of the refrigerant at the intake of medium temperature compressor 130 increases in certain embodiments. Heat exchanger 205 thus obviates the need for hot gas dump valve 140 in system 100.

In certain embodiments, heat exchanger 205 allows for a state change to occur in the flash gas from flash tank 110. For example, the flash gas from flash tank 110 may include a liquid component and a gaseous component when the flash gas reaches heat exchanger 205. By transferring heat to the flash gas, heat exchanger 205 may cause the liquid component in the flash gas to evaporate, thereby resulting in a flash gas that is only gaseous. The gaseous flash gas is then directed to medium temperature compressor 130. In this manner heat exchanger 205 reduces the odds that a liquid reaches medium temperature compressor 130, which reduces the chances that medium temperature compressor 130 foams and/or shuts down.

In certain embodiments, system 200 uses oil separator 210 to separate an oil from the refrigerant discharged by medium temperature compressor 130. Oil separator 210 receives the refrigerant from medium temperature compressor 130 and separates an oil from the refrigerant. Oil separator 210 then directs the refrigerant to heat exchanger 205. In particular embodiments, by separating the oil from the refrigerant, the efficiency of system 200 is improved because oil is prevented from flowing to other components of system 200, such as heat exchanger 205 and/or high side heat exchanger 105. Oil may cause these components to be damaged and/or clogged. Thus, oil separator 210 improves the efficiency and lifespan of other components of system 200 by separating oil from the refrigerant flowing in system 200. This disclosure contemplates that oil separator 210 is optional and that certain cooling systems may not include oil separator 210.

FIG. 3 illustrates an example cooling system 300. As shown in FIG. 3, system 300 includes a high side heat exchanger 105, a flash tank 110, a medium temperature load 115, a low temperature load 120, a low temperature compressor 125, a medium temperature compressor 130, a flash gas bypass valve 135, a heat exchanger 205, an oil separator 210, a valve 215, and a valve 220. Generally, system 300 obviates the need for a hot gas dump valve by transferring heat from the discharge of medium temperature compressor 130 to the intake of medium temperature compressor 130 using heat exchanger 205. As a result, the temperature and/or superheat of the intake of medium temperature compressor 130 is increased which improves the efficiency of medium temperature compressor 130 and prevents foaming and/or shutdown in certain embodiments.

High side heat exchanger 105, flash tank 110, medium temperature load 115, low temperature load 120, low temperature compressor 125, medium temperature compressor 130, flash gas bypass valve 135, heat exchanger 205, and oil separator 210 operate similarly as they did in systems 100 and 200. For example, high side heat exchanger 105 removes heat from a refrigerant. Flash tank 110 stores the refrigerant. Medium temperature load 115 and low temperature load 120 use the refrigerant to cool spaces proximate those loads. Low temperature compressor 125 compresses the refrigerant from low temperature load 120. Medium temperature compressor 130 compresses the refrigerant from medium temperature load 115 and/or gas from flash tank 110 and low temperature compressor 125. Flash gas bypass valve 135 opens and closes to control a flow of flash gas from flash tank 110. Heat exchanger 205 transfers heat from a refrigerant discharged by medium temperature compressor 130 to the flash gas discharged by flash tank 110. After heat transfer is complete, heat exchanger 205 directs the refrigerant to high side heat exchanger 105 and the flash gas to medium temperature compressor 130. Oil separator 210 separates an oil from the refrigerant discharged by medium temperature compressor 130.

An important difference between system 300 and system 200 is that system 300 includes a low temperature section such as, for example, low temperature load 120 and low temperature compressor 125. As a result, the refrigerant from medium temperature load 115 mixes with hot refrigerant from low temperature compressor 125 before reaching medium temperature compressor 130. In certain instances, however, the refrigerant from low temperature compressor 125 does not supply enough heat to the refrigerant from medium temperature load 115 to allow medium temperature compressor 130 to operate efficiently. For example, low temperature load 120 may be small and/or not running at full capacity. As a result, the refrigerant produced by low temperature compressor 125, although hot, is not of a sufficient volume to provide sufficient heat to the refrigerant from medium temperature load 115. As another example, during the summer when the ambient temperature is high, there may not be enough heat energy in the refrigerant from medium temperature load 115 and/or low temperature compressor 125 to allow medium temperature compressor 130 to operate efficiently.

In these instances, heat exchanger 205 can transfer heat from the refrigerant discharged by medium temperature compressor 130 to flash gas discharged by flash tank 110. The heated flash gas then mixes with the refrigerant from medium temperature load 115 and the refrigerant from low temperature compressor 125 at the intake of medium temperature compressor 130. As a result, the intake of medium temperature compressor 130 may have sufficient superheat to allow medium temperature compressor 130 to operate efficiently in certain embodiments.

Valves 215 and 220 are controlled to control the flow of flash gas in system 300. For example, when the refrigerant at the intake of medium temperature compressor 130 does not have a sufficiently high temperature and/or superheat, valves 215 and 220 may operate in a first mode of operation to allow flash gas from flash tank 110 to be heated in heat exchanger 205. During this first mode of operation, valve 215 may be open and valve 220 may be closed. As a result, flash gas from flash tank 110 flows through valve 215 to heat exchanger 205. Heat exchanger 205 then transfers heat from the refrigerant from medium temperature compressor 130 to the flash gas. Heat exchanger 205 then directs the flash gas to medium temperature compressor 130 where the heated flash gas mixes with the refrigerant from medium temperature load 115 and low temperature compressor 125. When the temperature and/or superheat at the intake of medium temperature compressor 130 is sufficiently high, valves 215 and 220 are controlled to operate in a second mode of operation. During the second mode of operation, valve 215 is closed and valve 220 is open. As a result, flash gas from flash tank 110 flows through valve 220 to medium temperature compressor 130 bypassing heat exchanger 205. In this manner, the flow of flash gas from flash tank 110 is controlled such that the temperature and/or superheat at the intake of medium temperature compressor 130 is controlled.

In certain embodiments, valve 220 is a check valve. Flash gas from flash tank 110 can flow through valve 220 when a pressure of the flash gas exceeds a threshold that is set for valve 220. Thus, valve 220 opens when the pressure of the flash gas exceeds the threshold and closes when the pressure of the flash gas falls below the threshold. The pressure of the flash gas is controlled by opening and/or closing valve 215. By opening valve 215 (e.g., during the first mode of operation discussed above), flash gas is directed to heat exchanger 205, thus reducing the pressure of the flash gas at valve 220. When valve 215 is closed (e.g., during the second mode of operation discussed above), the pressure of the flash gas at valve 220 increases. When the pressure of the flash gas exceeds the threshold, valve 220 opens and the flash gas flows to medium temperature compressor 130, bypassing heat exchanger 205.

Certain embodiments may exclude valve 215. In these embodiments, flash gas flows from flash tank 110 through heat exchanger 205 to medium temperature compressor 130 when valve 220 is closed (e.g., during the first mode of operation discussed above). When valve 220 is open (e.g., during the second mode of operation discussed above), flash gas flows through valve 220 to medium temperature compressor 130, bypassing heat exchanger 205. In this manner, the flow of flash gas from flash tank 110 is controlled even though valve 215 is missing from the system.

FIG. 4 is a flow chart illustrating a method 400 of operating an example cooling system. In particular embodiments, various components of cooling systems 200 and 300 perform the steps of method 400. By performing these steps, the components obviate the need for a hot gas dump valve in the cooling system.

In step 405, a high side heat exchanger removes heat from a refrigerant. A flash tank stores the refrigerant in step 410. In step 415, the flash tank discharges a flash gas. A load uses the refrigerant to cool a space in step 420. In step 425, a compressor compresses the refrigerant.

A heat exchanger transfers heat from the refrigerant from the compressor to the flash gas discharged by the flash tank in step 430. The heat exchanger then directs the flash gas to the compressor in step 435. In this manner, heat from the refrigerant discharged by the compressor is directed back to the intake of the compressor to heat the refrigerant at the intake of the compressor. As a result, the efficiency of the compressor is improved in certain embodiments. In step 440, the heat exchanger directs the refrigerant to the high side heat exchanger.

Modifications, additions, or omissions may be made to method 400 depicted in FIG. 4. Method 400 may include more, fewer, or other steps. For example, steps may be performed in parallel or in any suitable order. While discussed as systems 200 and/or 300 (or components thereof) performing the steps, any suitable component of systems 200 and/or 300 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger, the medium temperature compressor, etc.) even though there may be other intervening components between the particular component and the destination of the refrigerant. For example, the heat exchanger receives a refrigerant from the medium temperature compressor even though there may be an oil separator between the heat exchanger and the medium temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a flash tank configured to store the refrigerant from the high side heat exchanger and to discharge a flash gas having a liquid component and a gaseous component;

a first load configured to use the refrigerant to cool a first space proximate the first load;

a first compressor configured to compress the refrigerant from the first load;

a heat exchanger configured to:

transfer heat from the refrigerant to the flash gas before the refrigerant from the first compressor reaches the high side heat exchanger;

direct the flash gas to the first compressor after heat from the refrigerant from the first compressor is transferred to the flash gas; and direct the refrigerant from the first compressor to the high side heat exchanger after heat from the refrigerant from the first compressor is transferred to the flash gas;

a gas bypass valve disposed downstream of the flash tank operable to direct the liquid component and the gaseous component of the flash gas from the flash tank to a suction side of the first compressor;

a first valve positioned between the gas bypass valve and the first compressor, wherein:

during a first mode of operation, the first valve is closed to prevent flash gas from flowing from the flash tank to the first compressor; and during a second mode of operation, the first valve is open to direct flash gas from the flash tank to the first compressor such that the flash gas bypasses the heat exchanger.

2. The apparatus of claim 1, wherein the first valve is a check valve configured to direct the flash gas from the flash tank to the first compressor if a pressure of the flash gas exceeds a threshold.

3. The apparatus of claim 1, further comprising an oil separator configured to separate an oil from the refrigerant from the first compressor before the refrigerant from the first compressor reaches the heat exchanger.

4. The apparatus of claim 3, wherein the oil separator is positioned between the first compressor and the heat exchanger.

5. The apparatus of claim 1, wherein:

the flash gas liquid component transitions to a gas when the heat exchanger transfers heat from the refrigerant from the first compressor to the flash gas.

6. A method comprising:

removing, by a high side heat exchanger, heat from a refrigerant;

storing, by a flash tank, the refrigerant from the high side heat exchanger;

discharging, by the flash tank, a flash gas having a liquid component and a gaseous component;

using, by a first load, the refrigerant to cool a first space proximate the first load;

compressing, by a first compressor, the refrigerant from the first load; and transferring, by a heat exchanger, heat from the refrigerant to the flash gas before the refrigerant from the first compressor reaches the high side heat exchanger;

directing, by the heat exchanger, the flash gas to the first compressor after heat from the refrigerant from the first compressor is transferred to the flash gas;

directing, by the heat exchanger, the refrigerant from the first compressor to the high side heat exchanger after heat from the refrigerant from the first compressor is transferred to the flash gas;

directing, by a gas bypass valve disposed downstream of the flash tank, the liquid component and the gaseous component of the flash gas from the flash tank to a suction side of the first compressor;

preventing, by a first valve positioned between the gas bypass valve and the first compressor, during a first mode of operation, flash gas from flowing from the gas bypass valve to the first compressor; and directing, by the first valve, during a second mode of operation, flash gas from the flash tank to the first compressor such that the flash gas bypasses the heat exchanger.

7. The method of claim 6, further comprising directing, by the first valve, the flash gas from the flash tank to the first compressor if a pressure of the flash gas exceeds a threshold, the first valve is a check valve.

8. The method of claim 6, further comprising separating, by an oil separator, an oil from the refrigerant from the first compressor before the refrigerant from the first compressor reaches the heat exchanger.

9. The method of claim 6, further comprising:

using, by a second load, the refrigerant from the flash tank to cool a second space proximate the second load;

compressing, by a second compressor, the refrigerant from the second load; and compressing, by the first compressor, the refrigerant from the second compressor.

10. The method of claim 6, wherein:

the flash gas liquid component transitions to a gas when the heat exchanger transfers heat from the refrigerant from the first compressor to the flash gas.

11. A system comprising:

a high side heat exchanger configured to remove heat from a refrigerant;

a flash tank configured to store the refrigerant from the high side heat exchanger and to discharge a flash gas having a liquid component and a gaseous component;

a first load configured to use the refrigerant to cool a first space proximate the first load;

a first compressor configured to compress the refrigerant from the first load;

a second load configured to use the refrigerant from the flash tank to cool a second space proximate the second load;

a second compressor configured to compress the refrigerant from the second load, the first compressor further configured to compress the refrigerant from the second compressor;

a heat exchanger configured to:

transfer heat from the refrigerant to the flash gas before the refrigerant from the first compressor reaches the high side heat exchanger;

direct the flash gas to the first compressor after heat from the refrigerant from the first compressor is transferred to the flash gas; and direct the refrigerant from the first compressor to the high side heat exchanger after heat from the refrigerant from the first compressor is transferred to the flash gas;

a gas bypass valve disposed downstream of the flash tank operable to direct the liquid component and the gaseous component of the flash gas from the flash tank to a suction side of the first compressor; and a first valve positioned between the gas bypass valve and the first compressor, wherein:

during a first mode of operation, the first valve is closed to prevent flash gas from flowing from the flash tank to the first compressor; and during a second mode of operation, the first valve is open to direct flash gas from the flash tank to the first compressor such that the flash gas bypasses the heat exchanger.

12. The system of claim 11, wherein the first valve is a check valve configured to direct the flash gas from the flash tank to the first compressor if a pressure of the flash gas exceeds a threshold.

13. The system of claim 11, further comprising an oil separator configured to separate an oil from the refrigerant from the first compressor before the refrigerant from the first compressor reaches the heat exchanger.

14. The system of claim 11, wherein:

the flash gas liquid component transitions to a gas when the heat exchanger transfers heat from the refrigerant from the first compressor to the flash gas.

* * * * *